United States Patent [19]

Biebuyck

[11] 4,194,776

[45] Mar. 25, 1980

[54] SECURITY ASTRAGAL FOR DOUBLE DOOR ASSEMBLY

[75] Inventor: Lawrence F. Biebuyck, Dallas, Tex.

[73] Assignee: Howmet Corporation, New York, N.Y.

[21] Appl. No.: 861,353

[22] Filed: Dec. 16, 1977

[51] Int. Cl.[2] ..... E05C 19/02

[52] U.S. Cl. ..... 292/346

[58] Field of Search ..... 292/280, 304, 341.18, 292/346, 78; 70/416, 418

[56] References Cited

U.S. PATENT DOCUMENTS

| | | | |
|---|---|---|---|
| 661,653 | 11/1900 | Youlten | 49/388 |
| 3,959,927 | 6/1976 | Good | 49/368 |

*Primary Examiner*—Richard E. Moore

*Attorney, Agent, or Firm*—Thomas L. Cantrell; Joseph H. Schley

[57] ABSTRACT

Disclosed is a security astragal for double door assemblies which includes a gear-toothed rod rotatably mounted in the meeting edge of one of the doors, and a rod-engaging blade mounted on the meeting edge of the other door. Both the rod and the blade preferably extend for the full height of the door. When the doors are swung relative to each other, the blade engages the teeth on the rod and rotates the rod sufficiently to enable the blade to move partly or fully past the rod. When the doors are in closed position, the blade and rod are in gear-like interengagement, making it impossible to insert a coat hanger or other jimmying tool between the two doors for manipulating the latch mechanism on the inside of the doors.

11 Claims, 8 Drawing Figures

SECURITY ASTRAGAL FOR DOUBLE DOOR ASSEMBLY

BACKGROUND OF THE INVENTION

Double panic doors are required in many buildings such as schools, public buildings and the like, and double doors, whether equipped with panic features or not, are the door arrangement of choice in many other buildings. The term "double door" as used herein, refers to a pair of doors hung in a doorway so that their outer edges substantially meet, i.e., there is no center doorpost in the doorway. Double doors may be mounted to swing inwardly, outwardly, or both.

Double panic doors are doors equipped with bar type latch operators so that the door may be unlatched and opened quickly in a panic situation. The latching mechanisms of the doors generally include latching rods mounted within the meeting stiles of the doors, and cranks for seating and unseating the rods in recesses in the doorsill and door header. It is an essential requirement of double panic doors that either door may be opened independently of the opening or unlatching of the other door of the pair.

Heretofore, the foregoing features and characteristics of double panic doors have made them inherently poor doors from a building security standpoint. The independent-opening feature of such doors precludes the use of overlapping flanges at the meeting edges of the doors for preventing insertion of a jimmying tool between the doors. The large, easy-to-find, easy-to-manipulate panic bars are readily findable and engagable by a jimmying tool worked between the meeting edges of the door. In many cases it takes only a few minutes work with a coat hanger to open a double panic door from the outside.

CERTAIN PRIOR ART

One approach to dealing with the security problem outlined above is typified by U.S. Pat. No. 3,660,940, which illustrates a panic bar system in which the cranks of the latch displace a laterally movable element into and out of the gap between the door edges. Such a system has the commercial disadvantage that it is associated with a particular latching system and thus limits the buying choice of one selecting panic door hardware. In addition, it involves a relatively complex set of linkages and other parts which must be counted upon to function without jamming.

Another approach to the problem is illustrated in U.S. Pat. No. 3,959,927, which shows panic doors with a pair of gear-teeth rollers which interengage each other, or alternately, a gear-toothed bar may replace one of the rollers. A similar arrangement, although not in a panic door environment, is employed in the casement window structure of U.S. Pat. No. 661,653. While these systems are not operatively connected to the latching mechanism, and are free of consequent objections relating to such connection, they are very dependent on precision alignment of the parts with respect to each other and upon maintenance of such alignment despite the jarring involved in opening and closing of doors.

Still other approaches to providing seals between the meeting edges of doors are shown in the prior art cited against U.S. Pat. No. 3,959,927, namely, U.S. Pat. Nos. 661,653 Youlten; 1,270,896 Relling; 2,797,958 Podolan; 3,077,644 Kesling; 3,150,422 Michaels; 3,487,581 Ellingson, Jr.; 3,590,531 Childs; 3,653,155 Brunyn, Jr. et al; 3,660,940 Tavano; 3,827,183 Zimmerman et al; Germany No. 870,176; France No. 1,342,662 and Sweden No. 46,348. Not all of these deal with the panic door environment.

SUMMARY OF THE INVENTION

In accordance with the present invention, an improved security astragal is provided which is simple and rugged in construction, reliable in operation, and relatively insensitive to problems of alignment between parts. The astragal of the invention is independent of the latch system of the doors, and permits the doors to be opened in any order. It can be used with doors which swing in one direction or in both directions. It effectively prevents insertion of a jimmying tool between the door edges. Such an insertion can be accomplished only by destructive distortion of the parts.

The astragal of the invention includes a gear-toothed rod which is rotatably mounted in an open channel on the meeting edge of one of a pair of doors. The rod is positioned in the channel so that it projects slightly beyond the edges of the channel. The channel is formed in the meeting stile of the door and extends for a selected portion of the height of the stile, preferably for substantially its full height. Preferably, the rod extends the full length or height of the channel.

On the meeting edge of the other door of the pair, a blade is mounted so that its nose projects into the path of rotation of the gear teeth of the rod when the doors are in meeting alignment or nearly so. With the blade and gear-toothed rod interengaged, there is no room to force a jimmying tool between the door edges. When one door swings in relation to the other, the rod rotates so the blade can move out of engagement with it.

The preferred mounting arrangement for the blade includes a step formed in the meeting stile of the door on which the blade is mounted. The floor of the step is aligned parallel with the plane of the door, and is preferably offset from that plane an amount sufficient, taking into account the shape and dimensions of the blade, to place the nose of the blade substantially in the plane of the door when the blade is mounted on the floor of the step. The step is oriented toward the meeting edge of the door and toward the indoor side of the door. In accordance with the invention, the blade is attached to the floor of the step so that it is adjustably positioned thereon. In this way, accommodation can be made for variations in the dimensions of doorways, as well as out-of-plumbness of one or both of the doors. After the blade has been suitably positioned on the floor of the step, a filler piece is preferably mounted over it to square off the corner of the door.

It is also preferred, in accordance with the invention, to "bow" the gear-toothed rod toward the door edge slightly. In the preferred embodiment of the invention, this is accomplished by mounting a short plastic block in the rod channel behind the rod about midway of its length. The block is dimensioned and shaped to bow the rod outwardly slightly, for example, about one-tenth of an inch in a seven foot long rod. It has been found that by thus stressing the rod, quietness and positiveness of operation are enhanced.

From the foregoing, it can be seen that it is a principal object of the present invention to provide a security astragal for double doors, particularly panic doors, which is simple and rugged in construction and reliable in operation.

The manner in which this object is attained, together with other objects and purposes, can be best understood from a consideration of the detailed description which follows, together with the accompanying drawings.

DESCRIPTION OF THE PREFERRED EMBODIMENT

Figure 1:
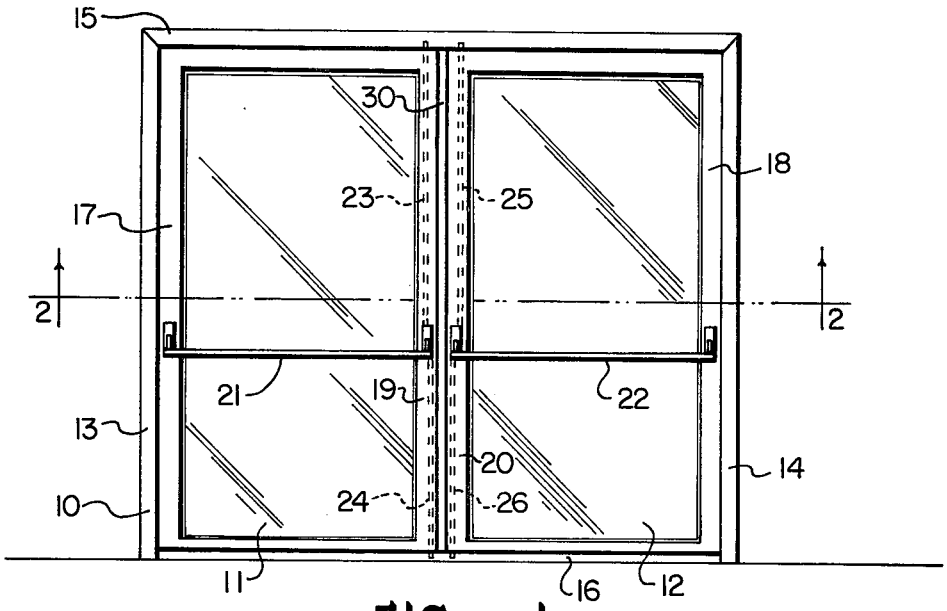
FIG. 1 is an inside elevational view of a pair of doors equipped with panic latches and with the security astragal of the invention.

In FIG. 1 there is illustrated a double-width doorway 10 having a pair of doors 11, 12 hung therein. The doorway 10 includes doorposts 13, 14, header 15, and sill 16. Each of the doors 11, 12 has a hinge stile 17, 18, and a meeting stile 19, 20.

The door system illustrated in FIG. 1 is a double door, as that term is used herein, and is equipped with a panic latch arrangement. The panic latch equipment includes panic bars 21, 22, and crank-operated rods 23, 24, 25, 26, which extend into recesses in the header and sill of the doorway when the doors are latched, and are withdrawn into the meeting stiles of the doors when the panic bars are pushed upon. (The cranks inside stiles 19, 20, are not shown in the drawings.) The astragal of the invention is mounted in the doors of FIG. 1 at their meeting edges, but the only portion thereof visible in FIG. 1 is a weathering strip 30, discussed below.

Figure 2:
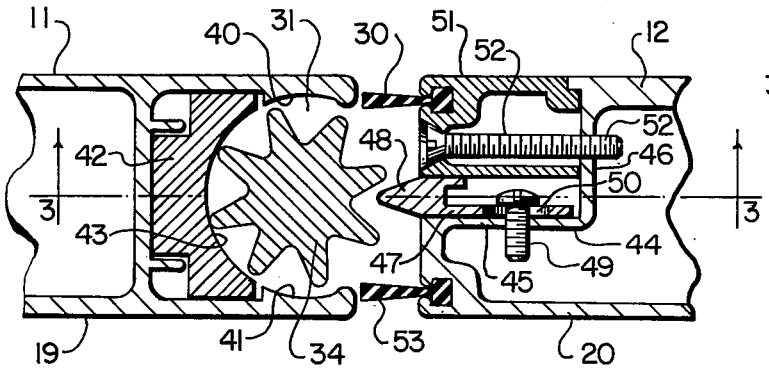
FIG. 2 is a fragmentary horizontal sectional view, on an enlarged scale compared to FIG. 1, of the doors of FIG. 1, and particularly the meeting stiles and the astragal of the invention, the view looking upwardly and being taken on the line 2—2 of FIG. 1.
Figure 3:
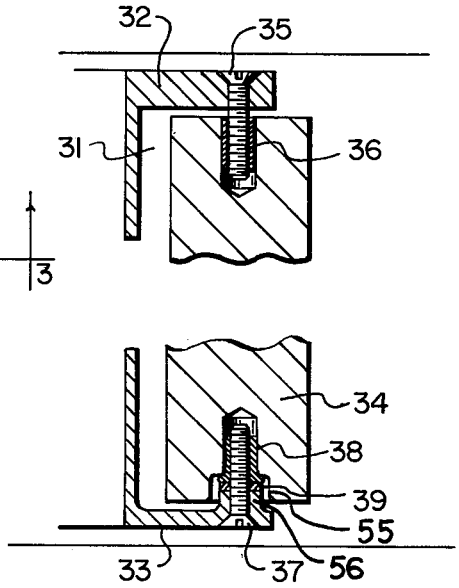
FIG. 3 is a fragmentary sectional elevational view of a portion of the astragal of FIG. 2, the section being taken on the line 3—3 of FIG. 2.
Figure 4:
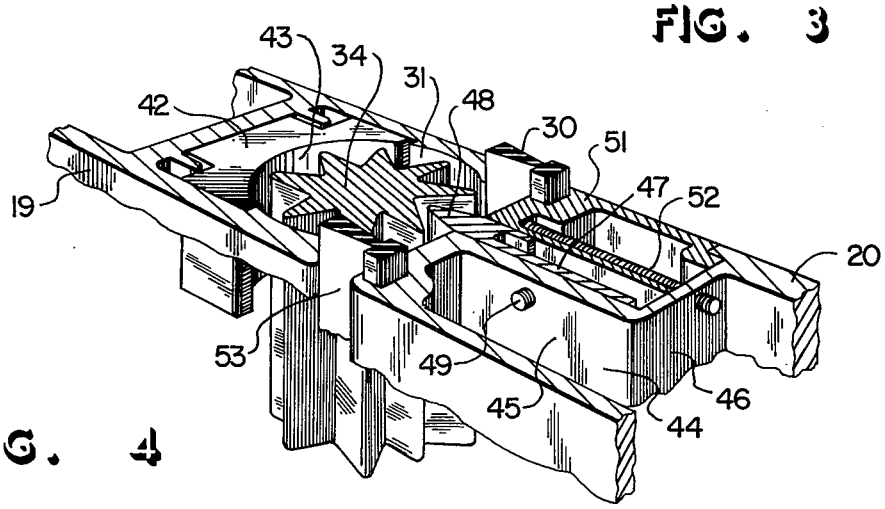
FIG. 4 is a fragmentary perspective view of the astragal of the invention.

Attention is now directed to FIGS. 2–4 which illustrate the structure of the astragal of the invention. In meeting stile 19 of door 11 there is formed a channel 31 which faces outwardly toward the edge of the stile. As can best be seen in FIG. 3, channel 31 is closed at its ends by plates 32, 33.

A gear-toothed rod 34 is mounted for rotation in channel 31. As is shown in FIG. 3, the mounting of rod 34 is by screw 35 and bushing 36 at the top plate 32, and by screw 37, bushing 38, and thrust washer 39 at the bottom plate 33. The number of teeth on rod 34 is not critical, nor is their shape, although it is preferred that they be relatively large and few in number, with fairly deep valleys between teeth and tapered sides of the teeth. The teeth run the full length of the rod. As can be seen in FIG. 2, the sides of channel 31 are preferably contoured, as at 40, 41, to provide bearing surfaces against which rod 34 can work as it rotates in operation.

In accordance with one feature of the invention, a short block 42, preferably formed of a plastic resin, is mounted in channel 31 behind rod 34. It, like the channel, is contoured, as at 43, to provide a bearing surface for rod 34. The block 42 is dimensioned and mounted so that it stresses rod 34 and bows it outwardly toward the mouth of channel 31. The extent of the bowing is relatively slight; about one tenth of an inch in a run of seven feet is suitable. The stressing of rod 34 is the manner just described makes it rotate more smoothly, positively, and quietly. Any tendency for the rod to rattle in operation is substantially eliminated.

As can be seen from FIGS. 2 and 3, rod 34 is positioned in channel 31 so that it projects part way past the edge of the channel into the gap between stile 19 and stile 20.

Meeting stile 20 has a step 44 formed in its meeting edge. Step 44 is oriented toward the meeting edge and toward the indoor side of the stile, as can be seen from FIGS. 2 and 4. The components of step 44 include floor 45 and back 46.

A blade 47 is mounted on the floor 45 of step 44 so that its nose 48 projects into the valley between adjacent teeth on rod 34 when the doors are in closed alignment, as appears in FIGS. 2 and 4. The preferred method of mounting of blade 47 is by means of a plurality of vertically spaced screws 49 passing through horizontally elongated slots 50 in blade 47. In accordance with the invention, blade 47 can be adjusted toward and away from rod 34 to an appropriate position during installation to take into account variations in doorway width from one doorway to another, and it can be skewed somewhat on floor 45 to bring it into parallel relationship with the axis of rod 34 notwithstanding that stiles 19, 20 might not be precisely plumb or parallel with each other. Since blade 47 is attached to floor 45 by screws, its position can be adjusted during the life of the doors, and a damaged or worn blade may be replaced.

After installation, blade 47 is covered, and the corner of stile 20 is squared off, by filler 51, which is attached to the stile by vertically spaced screws 52 driven into step back 46. Pile weathering strips 30 and 53 are mounted in slots in filler 51 and stile 20 respectively. It is preferred that the weathering strips be formed of plastic resin, and that they be mounted on the same stile as blade 47. The strips flex more readily past the teeth of rotatable rod 34 than they would past a fixed blade.

Referring again to FIG. 3, it can be seen that in accordance with the preferred form of the invention, bottom mounting plate 33 is relatively thinner than top plate 32, and is provided a boss 56, while rod 34 has a recess or cavity in the bottom end thereof large enough to accommodate the boss. In this way, provision is made to bring the bottom end of rod 34 as close to door sill 16 as is feasible, thus enhancing the anti-break-in characteristics of the astragal by reducing or eliminating the space through which a jimmying tool can be forced at the bottom of the door.

The mode of operation of the security astragal of the invention can best be seen from a consideration of FIGS. 5 through 8, which are horizontal sectional views much like FIG. 2, but somewhat simplified for clarity.

Figure 5:
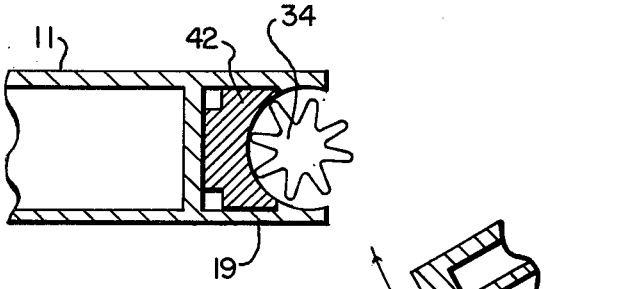
FIGS. 5 through 8 are a series of sectional views similar to FIG. 2, but somewhat simplified, showing different stages of operation of the astragal.
Figure 6:
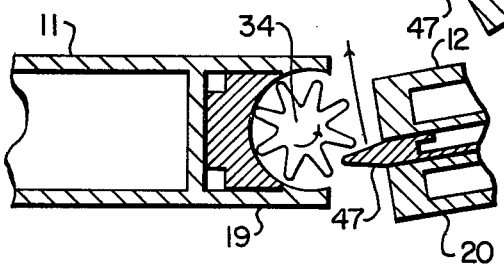
Figure 7:
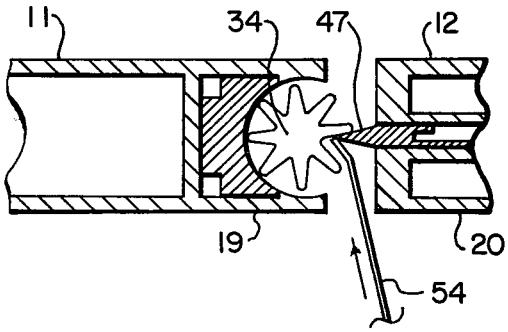

Considering FIGS. 5–7 sequentially first, it can be seen that as stile 20 swings toward meeting alignment with stile 19, blade 47 strikes a tooth of rod 34 and rotates the rod counterclockwise until the rod and blade are in gearlike engagement, as appears in FIG. 7 (and FIG. 2), when the stiles reach alignment. If FIGS. 5–7 are considered in reverse sequence, the action upon swinging door 12 open while leaving door 11 in its closed position can be appreciated. Rod 34 rotates clockwise as blade 47 is pushed free of engagement with it. Similar interaction between the rod and the blade occurs when door 11 is opened or closed with door 12 remaining closed, and when the doors are opened or closed simultaneously.

Figure 8:
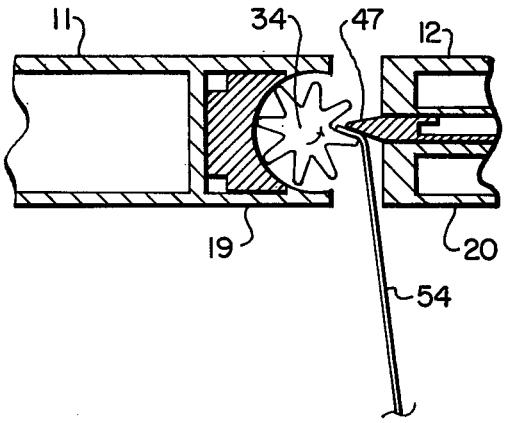

FIGS. 7 and 8 illustrate what occurs when one attempts to insert a jimmying tool such as a coat hanger wire between stiles 19 and 20 when they are in meeting alignment. As can be seen from those FIGS., the wire 54 cannot pass through the interengaged blade and rod teeth. An attempt to force it will rotate rod 34 slightly to bend and jam the wire, as is shown in FIG. 8.

I claim:

1. An astragal for a double door assembly comprising:

a first meeting stile for one of said doors;

a second meeting stile for the other of said doors;

said first stile having a channel formed in the edge thereof, said channel being open toward said second stile;

said second stile having a step formed in the edge thereof oriented toward said first stile and toward the indoor side of said other door;

a rod having a gear-toothed cross sectional profile rotatably mounted in said channel with teeth thereof projecting past the open edge of said channel; and a blade secured to said step having a nose projecting toward said rod sufficiently far to engage the gear teeth thereof when said stiles are brought into alignment upon closure.

2. An astragal in accordance with claim 1 in which said blade is adjustably secured to said step.

3. An astragal in accordance with claim 2 and further comprising a series of spaced elongate horizontal slots in said blade and a series of screws passing through said slots into said step.

4. An astragal in accordance with claim 1 and further comprising means biasing said rod toward said second stile.

5. An astragal in accordance with claim 4 in which said biasing means comprise a relatively short block mounted in the channel behind said rod about midway of its length.

6. An astragal in accordance with claim 1 and further comprising:

filler means mounted on said step for squaring off the indoor edge of said second stile;

a first weathering strip mounted at the outdoor edge of said second stile and extending toward said first stile; and a second weathering strip mounted on said filler means at the indoor edge of said second stile and extending toward said first stile.

7. An astragal for a double door assembly comprising:

a first meeting stile for one of said doors;

a second meeting stile for the other of said doors;

said first stile having a channel formed in the edge thereof, said channel being open toward said second stile;

a rod having a gear-toothed cross sectional profile rotatably mounted in said channel with teeth thereof projecting past the open edge of said channel;

a single blade mounted on said second stile substantially on the centerline thereof, said blade having a nose projecting toward said rod sufficiently far to engage the gear teeth thereof when said stiles are brought into alignment upon closure; and means biasing said rod toward said second stile, said biasing means comprising a relatively short block mounted in the channel behind said rod about midway of its length.

8. An astragal in accordance with claim 7 in which said single blade is adjustably mounted on said stile.

9. An astragal in accordance with claim 7 and further comprising a pair of weathering strips mounted at the indoor and outdoor edges of said second stile and extending toward said first stile.

10. An astragal for a double door assembly comprising:

a first meeting stile for one of said doors;

a second meeting stile for the other of said doors;

said first stile having a channel formed in the edge thereof, said channel being open toward said second stile;

a rod having a gear-toothed cross sectional profile rotatably mounted in said channel with teeth thereof projecting past the open edge of said channel;

a single blade mounted on said second stile substantially on the centerline thereof, said blade having a nose projecting toward said rod sufficiently far to engage the gear teeth thereof when said stiles are brought into alignment upon closure;

mounting means for said rod comprising mounting plates substantially closing the top and bottom ends of the channel in said first stile; and posts projecting from said plates and extending into the ends of said rod.

11. An astragal in accordance with claim 10 in which said bottom plate has a boss formed thereon and said rod has a recess in the bottom end thereof proportioned to fit over said boss.

* * * * *